US007333756B2

(12) United States Patent
Schoch et al.

(10) Patent No.: US 7,333,756 B2
(45) Date of Patent: Feb. 19, 2008

(54) METHOD AND DEVICE FOR THE TRANSPORT OF TONER MATERIAL FROM A RESERVOIR

(75) Inventors: Bernd Schoch, Heimstetten (DE); Ursula Schäfer, Penzberg (DE); Karl Zappe, Schwindegg (DE)

(73) Assignee: Oce Printing Systems GmbH, Poing (DE)

( * ) Notice: Subject to any disclaimer, the term of this patent is extended or adjusted under 35 U.S.C. 154(b) by 261 days.

(21) Appl. No.: 10/514,229

(22) PCT Filed: May 23, 2003

(86) PCT No.: PCT/EP03/05431

§ 371 (c)(1),
(2), (4) Date: Jun. 23, 2005

(87) PCT Pub. No.: WO03/100530

PCT Pub. Date: Dec. 4, 2003

(65) Prior Publication Data

US 2006/0024101 A1 Feb. 2, 2006

(30) Foreign Application Priority Data

May 24, 2002 (DE) ..... 102 23 231

(51) Int. Cl.
*G03G 15/08* (2006.01)

(52) U.S. Cl. ..... 399/258; 399/260

(58) Field of Classification Search ..... 399/258, 399/260, 262

See application file for complete search history.

(56) References Cited

U.S. PATENT DOCUMENTS

| | | | | |
|---|---|---|---|---|
| 4,990,964 | A | 2/1991 | Kraehn | |
| 5,074,342 | A | 12/1991 | Kraehn | |
| 5,727,607 | A | 3/1998 | Ichikawa et al. | |
| 5,884,126 | A | 3/1999 | Schoch et al. | |
| 5,915,154 | A | 6/1999 | Schoch et al. | |
| 6,201,941 | B1 | 3/2001 | Kasahara et al. | |
| 6,826,381 | B2 * | 11/2004 | Muramatsu et al. | 399/260 |
| 6,889,026 | B2 * | 5/2005 | Schlageter et al. | 399/258 |
| 7,010,249 | B2 * | 3/2006 | Hattori | 399/258 |
| 7,043,179 | B2 * | 5/2006 | Matsumoto et al. | 399/258 |
| 7,076,191 | B2 * | 7/2006 | Muramatsu et al. | 399/258 |

(Continued)

FOREIGN PATENT DOCUMENTS

DE 196 52 860 6/1998

(Continued)

*Primary Examiner*—William J. Royer
(74) *Attorney, Agent, or Firm*—Schiff Hardin LLP

(57) ABSTRACT

In a method and system for transport of toner material, a reservoir arrangement containing the toner material is provided with a removal opening for removal of the toner material. The toner material is transported away from the removal opening with aid of a tube-shaped conduit, the toner material being transported in the tube-shaped conduit via an air current. A negative pressure is generated relative to environment pressure at the removal opening via the air current in the tube-shaped conduit. The reservoir arrangement is provided with at least one air-permeable and toner-tight region through which air is sucked into the reservoir arrangement upon application of the negative pressure. At least the air-permeable and toner-tight region is partitioned airtight from the environment, environment air being supplied to the partitioned region via a dosing nozzle.

18 Claims, 10 Drawing Sheets

U.S. PATENT DOCUMENTS

| | | | | |
|---|---|---|---|---|
| 7,218,880 | B2 * | 5/2007 | Yanagisawa et al. | ..... 399/258 |
| 2001/0041083 | A1 | 11/2001 | Terazawa et al. | |

FOREIGN PATENT DOCUMENTS

| | | |
|---|---|---|
| DE | 199 29 009 | 1/2000 |
| DE | 100 44 219 | 5/2002 |
| DE | 102 23 206 | 12/2003 |
| DE | 102 23 232 | 12/2003 |
| EP | 1 154 333 | 11/2001 |

* cited by examiner

METHOD AND DEVICE FOR THE TRANSPORT OF TONER MATERIAL FROM A RESERVOIR

BACKGROUND

The disclosure relates to a method and a device for the transport of toner material from a reservoir. Toner material is conveyed away from an extraction opening of the reservoir via an air current. The disclosure also concerns a tube-shaped conduit for the transport of toner material and a sealing device to seal a reservoir via which a simple extraction of toner material from the reservoir is possible.

In electrophotographic printers or copiers, a latent charge image is generated on a light-sensitive photoconductor material, a photoconductor drum or a photoconductor band. This charge image is subsequently inked with electrically-charged toner in a developer station of the printer or copier. The inked toner image is subsequently transferred to a carrier material, for example paper, and is fixed on this.

A one-component developer or a two-component developer is used to develop the latent charge image in the developer station. The one-component developer comprises only toner particles; the two-component developer comprises a mixture of toner particles and carrier particles. In the two-component developer, the toner particles are electrically charged via movements of the two-component developer mixture. In the one-component developer, the charging of the toner particles occurs via charge transport, for example by a carrier roller.

The toner quantity necessary: to generate the toner image must be supplied to the developer station in order to be able to generate further toner images. In known printers or copiers, near the developer station a temporary storage for toner material is provided from which toner material is transported into the developer station as needed or as requested.

In known printers or copiers, the temporary storage is filled with toner material from handy toner transport reservoirs through an opening directly into the reservoir, or is conveyed into the temporary storage via a transport system from a separately arranged transport reservoir. In known printers or copiers, the temporary storage near the developer station has a fill level sensor. Given a minimal fill level, toner material must be supplied to the temporary storage from the toner transport reservoir. This occurs, for example, via emptying a transport reservoir into the temporary storage. In other known arrangements, sealed reservoirs filled with toner material and in the form of bottles or cartridges are adapted to an opening in the temporary storage. The bottle or cartridges is opened by pulling a slider and/or ripping open a flap, whereby the toner material can fall into the reservoir.

However, in these solutions to refill toner material into the temporary storage, a high danger of contamination exists for operating personnel and the environment of the temporary storage upon filling of the toner material and upon removal of the emptied transport reservoir. A low weight and a small structural size of the bottles and/or cartridges in fact enables a simple manipulation and a safe handling upon refilling of the temporary storage. However, given a high toner usage a frequent refilling of the reservoir is necessary, whereby long machine downtimes are created and the operating personnel is severely stressed.

A toner reservoir and a device for contamination-free exchange of such a toner reservoir in a toner transport device of a printer or copier is known from the documents U.S. Pat. No. 4,990,964 and U.S. Pat. No. 5,074,342. Toner material is transported as needed from a toner reservoir arranged separate from the developer station into the temporary storage as needed via a tube, with the aid of suction air. A vertically displaceable suction spout is immersed through an opening arranged in the top of the toner reservoir and sucks toner material out. A special shaping of the toner reservoir and a laterally connected vibrating unit provide for a nearly complete emptying of the reservoir. The suction spout is drawn from the reservoir to exchange the reservoir. The opening in the toner reservoir is always arranged on top, whereby a spillage of toner is prevented. However, the conveying capacity is strongly dependent on the fill state in the toner reservoir. The conveying capacity also decreases with a reduction of the fill level, such that the printing event is interrupted given a low toner level in the reservoir and a simultaneously large toner requirement in the developer station. The vibrating unit also causes disturbing noises.

An apparatus to convey toner material from a reservoir by means of a suction and force unit that protrudes into the reservoir is also known from the document U.S. Pat. No. 5,915,154 or DE 196 52 860 A1. Toner material is interspersed with gas with the aid of the suction and force unit, such that the toner material to be vacuumed is mixed into a powder-gas mixture, whereby the suction of the fine-powder toner material from the reservoir is eased. However, the problem also occurs in this known device that the conveying capacity also decreases with a decrease of the fill level in the reservoir, and it leads to an already-described interruption of the print process as a consequence of a too-small toner material redelivery.

A device for the transport of toner material in which toner material is output from a reservoir onto a slanted plane is known from the document U.S. Pat. No. 5,884,126. The surface of the slanted plane comprises porous elements via which air penetrates from below through the surface to the toner material and intersperses the toner material with air, whereby a fluid-like mixture made of toner material and air forms. This mixture flows downwards on the slanted plane into a temporary toner storage. However, with such a known apparatus toner material can only be transported to lower-lying positions, whereby given this transport type it is also necessary to provide further means in order to prevent contaminations of the printer or copier upon transport of the toner material.

A device for the removal of toner material from a reservoir is known from the document U.S. Pat. No. 5,727,607. In this known device, air is pushed through air-permeable regions of the removal device into the toner reservoir with the aid of overpressure, whereby a toner-air mixture is created in the toner reservoir. The toner-air mixture falls downwards out of the reservoir through a removal opening into a capture device.

SUMMARY

It is an object to specify a simple method and a simple arrangement for the transport of toner material from a reservoir wherein the reservoir is also nearly completely emptied even given solidified toner material. Furthermore, a tube-shaped conduit for the transport of toner material and a sealing device to seal a toner reservoir are to be specified in which the removal of toner material is possible.

In a method and system for transport of toner material, a reservoir arrangement containing the toner material is provided with a removal opening for removal of the toner material. The toner material is transported away from the removal opening with aid of a tube-shaped conduit, the toner material being transported in the conduit via an air current. A negative pressure is generated relative to environment pressure at the removal opening via the air current in the conduit. The reservoir arrangement is provided with at least one air-permeable and toner-tight region through which air is sucked into the reservoir arrangement upon application of the negative pressure. At least the air-permeable and toner-tight region is partitioned airtight from the environment, environment air being supplied to the partitioned region via a dosing nozzle.

DESCRIPTION OF THE PREFERRED EMBODIMENTS

Figure 1:
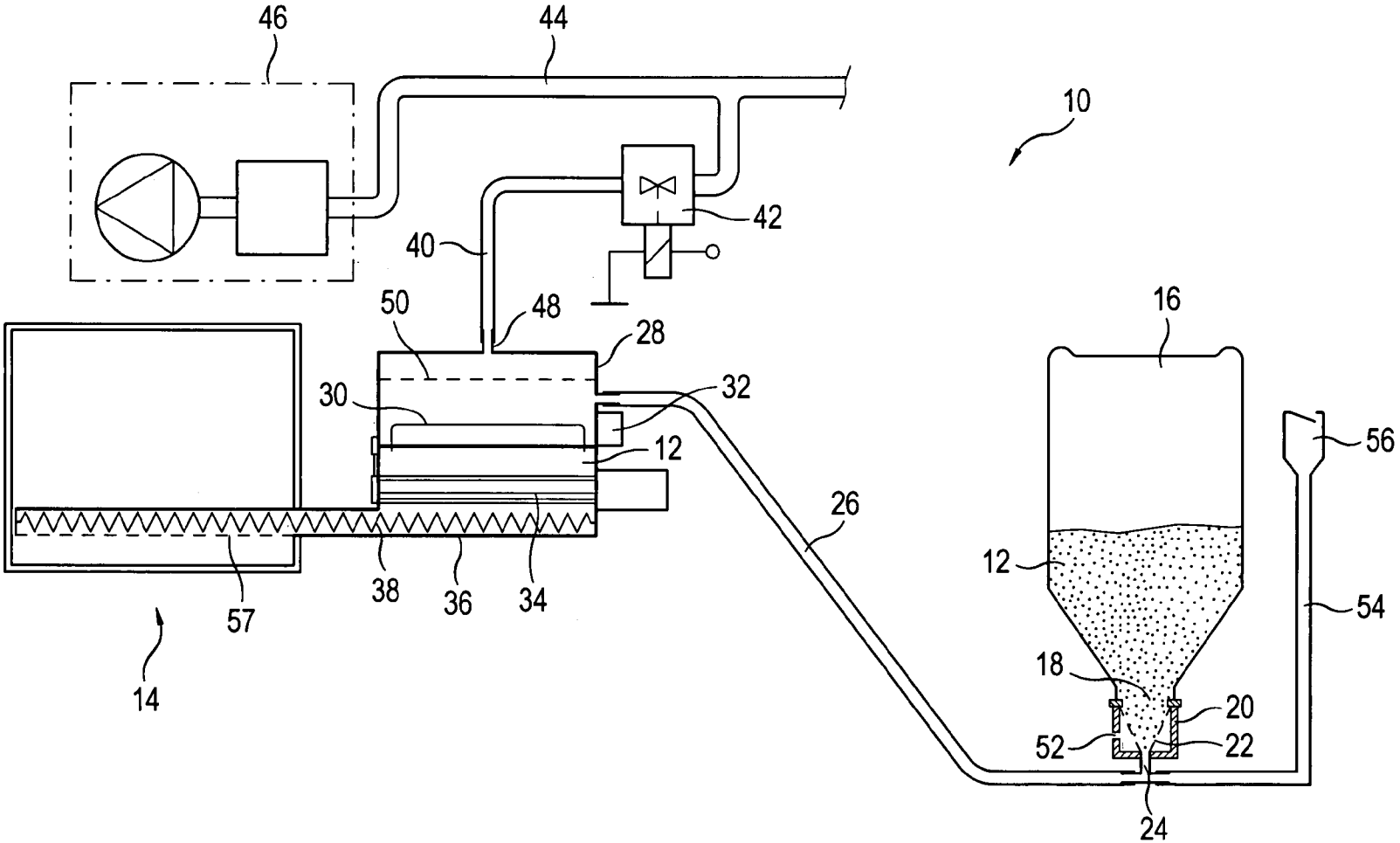
FIG. 1 shows a schematic design of a toner conveyance system in a printer or copier.

For the purposes of promoting an understanding of the principles of the invention, reference will now be made to the preferred embodiments illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

A reservoir arrangement contains toner material that is removed from the reservoir arranged via a removal opening. The toner material is conveyed away from the removal opening with the aid of a tube-shaped conduit connected at least with the removal opening. The toner material is transported in the conduit via an air current. A negative pressure is generated at the removal opening via the air current. The reservoir arrangement comprises at least one air-permeable region through which air flows into the reservoir arrangement upon application of a negative pressure.

A toner material-air mixture that has fluid-like properties and that is thus free-flowing is generated in at least one section of the reservoir arrangement via the in-flowing air. Such a fluid-like toner material-air mixture is also designated as a fluidized toner material. The toner material is thus free-flowing and simpler to transport. The toner material fluidized by the method is very simple to transport from the reservoir and can also be simply transported further into the printer or copier via the conduit connected with the removal opening. The fluidized toner material can simply be siphoned off without toner cornices or deposits being formed in the reservoir. Solidified toner material as it is present in the reservoir, for example after longer downtimes of the printer or copier, can also be conveyed from the reservoir just as simply as loose toner material with the method.

In a development, the air-permeable section is arranged near the removal opening. Primarily the toner material that is present in the area of the removal opening and is next siphoned through the removal opening is thereby interspersed with air. It is thus ensured that the toner material to be transported and conveyed through the removal opening is fluidized and can simply flow through the removal opening.

In another development, the removal opening is arranged in a lower section of the reservoir. The toner material can thereby slide for removal via gravity from an upper section of the reservoir to the removal opening and through this.

It is also advantageous to transport the toner material to a plurality of developer stations with the aid of the conduit. The quantity of toner material to be conveyed can simply be set via a dosing of the air quantity flowing past the removal opening.

In another development, the reservoir walls are also arranged funnel-shaped at least in the area of the removal opening. The toner material can thereby be nearly completely transported from the reservoir. The toner material slides along the funnel-shaped reservoir walls to the removal opening. No residues of toner material remain in the reservoir.

In a further advantageous embodiment, the air-permeable sections of the reservoir wall are sealed airtight from the environment. The sealed sections can be supplied environmental air via a dosing nozzle. The air quantity with which the toner material-air mixture is formed can thereby be simply adjusted.

The method can be implemented particularly simply when the air-permeable sections comprise sinter material made from steel, iron and/or bronze. Alternatively or additionally, the air-permeable sections can comprise a sieve or a filter agent. The air-permeable sections can thereby be simply executed toner-sealed and air-permeable, whereby they are simply designed and cost-effective materials are used.

A device for the transport of toner material has at least one reservoir arrangement that contains toner material that can be removed from the reservoir arrangement via a removal opening. The toner material can be conveyed away from the removal opening with the aid of a tube-shaped conduit connected at least with the removal opening. An air current via which the toner material can be transported through the conduit is generated in the conduit. The air current generates a negative pressure at the removal opening. The reservoir arrangement has at least one air-permeable region through which air flows into the reservoir arrangement upon application of the negative pressure. A toner material-air mixture is generated from the toner material present in the reservoir with the aid of the air flowing into the reservoir arrangement. This toner material-air mixture is free-flowing. The free-flowing mixture is particularly simple to convey and to transport. It can thereby be particularly simply transported from the reservoir into a developer station or even into a plurality of developer stations.

A tube-shaped conduit for the transport of toner material according to the invention comprises a first tube-shaped element whose wall is at least partially air-permeable. Furthermore, the tube-shaped conduit comprises a second tube-shaped element inside which the first tube-shaped element is arranged. The second tube-shaped element is essentially airtight. A free-flowing toner material-air mixture can thereby be generated in the first tube-shaped element with toner material that is introduced into the first tube-shaped element with the aid of compressed air that is introduced between the first tube-shaped element and the second tube-shaped element. Deposits of toner material in the first tube-shaped element are prevented. Such a tube-shaped conduit can also be used to distribute the toner material to a plurality of developer stations of the printer or copier. Also, no toner material deposits at curves of such a tube-shaped conduit, whereby obstructions of the conduits are prevented. Reservoirs sealed with the sealing element can also be used in the printer or copier via this device without the toner material escaping. Additional sealing elements such as, for example, draw flaps or screw caps are necessary neither for the transport of the reservoir nor for the use of the reservoir in the device.

In a development of this device, the sealing element is pressed against the inner side of the canted reservoir wall with the aid of an elastic force. The removal opening of the reservoir can be very simply securely sealed via the elastic force. An opening of the reservoir is then only possible via a movement of the sealing element against the elastic force. It is also ensured that the elastic force pushes the sealing element back into the first position (in which the removal opening of the reservoir is sealed) upon removal of the reservoir from the printer or copier.

It is thereby advantageous when the reservoir wall is designed conically towards the removal opening and when the sealing element essentially has the same conicity of at least one section of the conical reservoir wall. The removal opening of the reservoir can thereby be particularly simply sealed by the sealing element since the sealing element seals the reservoir on a revolving surface.

In another development, the sealing element has an opening towards the removal opening of the reservoir, via which compressed air can be supplied inside the sealing element. The sealing element has porous sections towards the inside of the toner reservoir through which the supplied compressed air flows into the inside of the reservoir. The toner material present in the toner reservoir is at least interspersed with air near the sealing element, whereby a free-flowing toner material-air mixture is created. The toner material can thereby particularly simply flow from the reservoir through the gap in the sealing element. Furthermore, it is achieved that the reservoir can be nearly completely emptied. Toner deposits or toner cornices in the reservoir cannot form even after longer downtimes of the printer or copier, since the free-flowing toner material-air mixture is formed with the aid of the supplied compressed air.

In an embodiment of this development, a compressed air connection element is present that, in the operating state, is connected airtight with the sealing element and pushes the sealing element into the second position. The compressed air connection of the sealing element can thereby be produced at the same time as the insertion of the reservoir, and the sealing element can be pushed into the second position. Elaborate operator control actions in the insertion of the reservoir are not necessary.

The air-permeable sections are likewise suitable to allow a gas such as, for example, nitrogen, oxygen or a noble gas to flow through, whereby a corresponding toner material-gas mixture is then formed. However, at present air is frequently used as a cost-effective gas. For simplification, in the present application the system is specified with the aid of air as a gas. However, the system can also be implemented with any arbitrary other gas.

A toner conveyance system 10 of a printer or copier is shown in FIG. 1. The toner conveyance system 10 serves to supply toner material 12 into a developer station 14. The toner material 12 is supplied to the printer or copier (not shown) via a reservoir 16 in which the toner material 12 is contained. An opening 18 serves for the removal of toner material 12. It is shown in a second, lower position, as is explained further below. A sealing device 20 is connected toner-sealed with the reservoir 16 such that toner material 12 slides from the reservoir 16 into the sealing device 20.

The sealing device 20 comprises a funnel 22 as an air-permeable section into which the toner material 12 slides from the reservoir 16. The funnel 22 has a funnel outlet 24 that is connected airtight and toner-sealed with a tube system 26. The tube system 26 connects the funnel outlet 24 with a temporary storage 28 that is arranged near the developer station 14 and in which toner material 12 is temporarily stored for further transport into the developer station 14. The temporary storage 28 comprises a stirring clip 30, a fill level sensor 32 and a dosing device 34 that comprises a paddle-wheel. A toner conveyance tube 36 with a toner conveyance spiral 38 connects the temporary storage 28 with the developer station 14 and conveys toner material 12 as needed from the temporary storage 28 to the developer station 14. With the aid of the dosing device 34 and/or the conveyance tube 36, which are respectively connected with a drive device (not shown), the quantity of toner material 12 conveyed into the developer station 14 is adjusted and dosed.

The stirring clip 30 stirs the toner material 12 into the temporary storage 28. The temporary storage 28 is airtight, whereby the airtight sealed chamber of the temporary storage 28 is connected with a central negative pressure line 44 via a tube system 40 that comprises a control valve 42. A negative pressure is generated in the central negative pressure line 44 via a vacuum blower 46. The tube system 40 is connected with an upper section of the temporary storage 28. A filter 50 is arranged below a connection location 48, facing the sealed chamber. The temporary storage 28 is connected with the tube system 26 below the filter 50. The control valve 42 regulates the negative pressure in the tube system 40 as well as in the temporary storage 28 connected with this, and in the tube system 26. This negative pressure provides that toner material 12 is transported from the funnel outlet 24 of the sealing device 20 into the chamber of the temporary storage 28 via the tube system 26.

The quantity of the conveyed toner material 12 can be analogously adjusted with the aid of the control valve 42 in many positions. However, in other exemplary embodiments the control valve 42 can also be operated in an on-off function, whereby the conveyed quantity of toner material 12 then depends on the negative pressure in the tube system 40 and the opening time of the control valve 42. Funnel 22 has porous, air-permeable funnel walls. Air is sucked through sealing device 20 into the funnel 22 through the funnel walls via the negative pressure at the funnel outlet 24. In the funnel 22, a toner-air mixture is thereby generated which is fluid-like, known as fluidic properties states. The air supplied through an opening 52 can be controlled via a valve (not shown). The funnel outlet 24 is also connected with a tube system 54 with a control valve 56 via which environmental air can be supplied to the tube system 54. Furthermore, a back-pressure valve (not shown) that prevents an escape of the toner material 12 even given disadvantageous pressure ratios in the tube systems 44, 26, 54 is comprised in the control valve 56. The quantity of toner material 12 that is conveyed from the reservoir 16 into the temporary storage 28 can be regulated via the control valve 56.

The control valves 42 and 56 are electrically-actuated valves. The negative pressure ratios in the temporary storage 28 and in the tube system 26 can be set exactly with the aid of the control valve 42. The toner transport from the reservoir 16 into the temporary storage 28 is regulated corresponding to the signal of the fill level sensor 32. The control valve 42 and the control valve 56 serve, as already mentioned, as actuators of the regulation. The suction air necessary for the toner transport is set via these control valves 42, 56. The toner material 12 exiting from the funnel outlet 24 is carried away by the air current in the tube system 26, 54 and is transported to the temporary storage 28. The filter 50 in the temporary storage 28 prevents the further transport: of the toner material 12 into the tube system 40.

After the sealing of the control valve 42, the clear air side of the filter 50 is aerated to ambient pressure. A negative pressure relative to the ambient pressure in the tube system 40 is thereby at least temporarily in the temporary storage 28. In the following pressure equalization between the tube system 40 and the temporary storage 28, air flows from the tube system 40 through the filter 50 into the temporary storage 28. The air current upon pressure equalization is directed opposite to the air current upon suction of the toner material 12. Toner material 12 fixed at the filter 50 is loosened by the air current upon pressure equalization and falls into the temporary storage 28. A potentially possible escape of toner material 12 via the tube system 54 is prevented by the control valve (back-pressure value) 56. As already mentioned, the toner material 12 is transported from the temporary storage 28 into the developer station 14 with the aid of a toner conveyance tube (transport tube) 36. The transport tube 36 protrudes with one end into the developer station 14 and has wide openings on this end on an underside 57, through which openings the toner material 12 falls from the transport tube 36 into the developer station 14.

The toner conveyance spiral (transport spiral) 38 contained in the transport tube 36 has a gradient, such that it transports the toner material 12 in the transport tube 36 similar to a screw transport tube from the temporary storage 28 to the developer station 14. The transport spiral 38 is, as already mentioned, driven with the aid of an actuating unit. The dosing device 34 comprises a roller like paddlewheel that is arranged between the temporary storage 28 and the transport tube 36. Such a dosing device 34 is also designated as a cell wheel sluice. The dosing device (paddle-wheel like roller) 34 nearly seals the temporary storage 28 airtight at the transport tube 36, such that air is sucked from the tube system 26 upon generation of a negative pressure with the aid of the vacuum blower 46. The paddlewheel-like roller 34 is preferably driven synchronously with the transport spiral 38, whereby given a rotation of the paddlewheel-like roller 34 (which is also designated as a cell wheel), toner material 12 falls from the temporary storage 28 into the bucket chambers or cells and is transported downwards to the transport tube 36 via the rotation.

Below the dosing device 34, the transport tube 36 has on the top an opening to the dosing device 34, such that the toner material 12 falls downwards from the cells into the transport tube 36. The stirring clip 30 inside the temporary storage 28 is driven with the aid of an actuating unit (not shown) and, via a rotation, prevents a cavity formation or cornice formation in the toner material 12 of the temporary storage 28.

Figure 2:
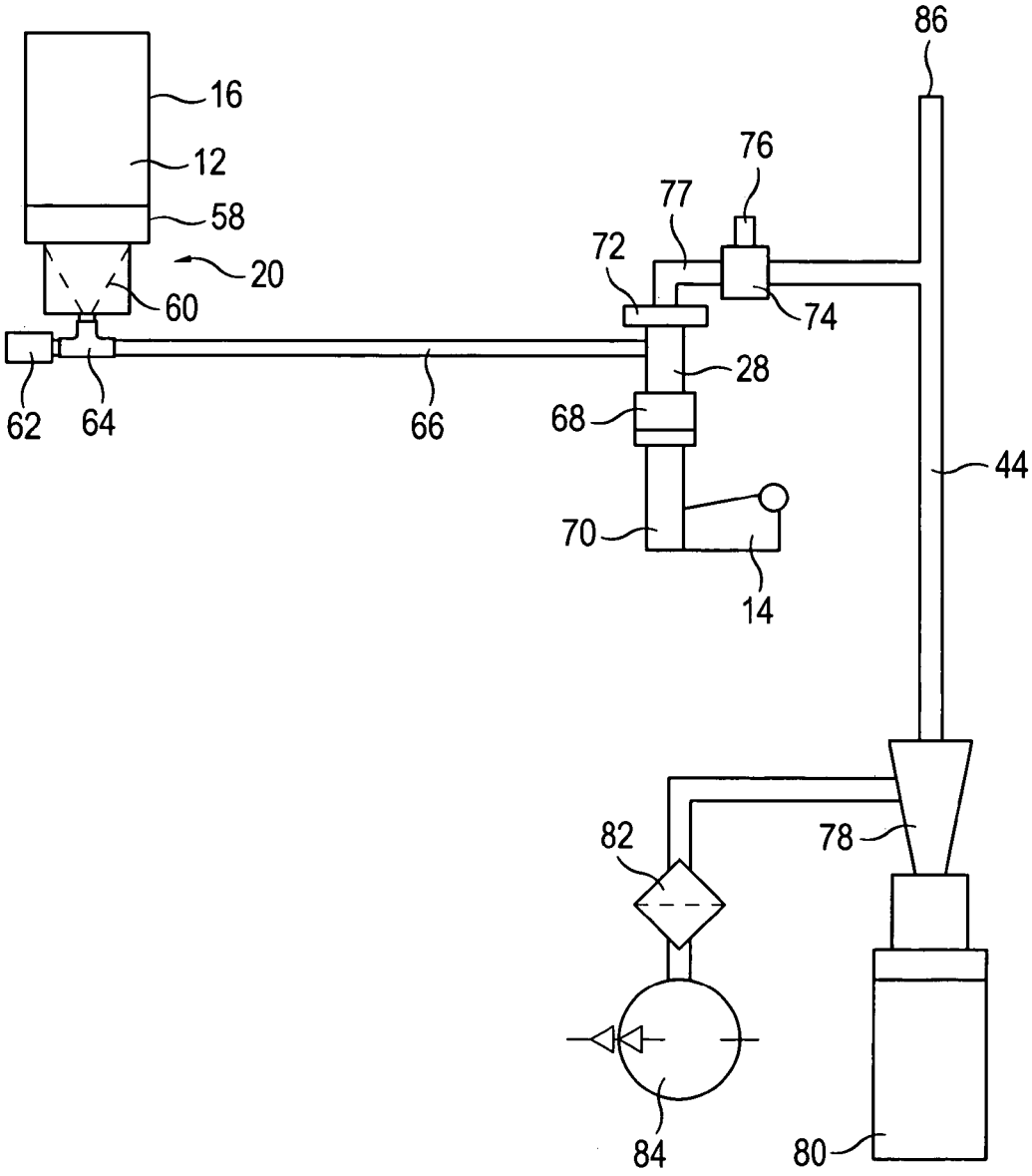
FIG. 2 illustrates a schematic design of a second toner conveyance system.

FIG. 2 shows the schematic design of a second toner conveyance system similar to the toner conveyance system 10 according to FIG. 1. Identical elements have the same reference characters.

Contained in the reservoir 16 is toner material 12 that is conveyed into a developer station 14 with the aid of the schematically shown toner conveyance system. A coupling device 58 that connects the reservoir 16 with a discharge device 60 is arranged at the reservoir 16. The coupling device 58 and the discharge device 60 are contained in the sealing device 20. The design of the discharge device 60 is subsequently explained in further detail in connection with FIG. 3. With the aid of the discharge device 60, the toner material 12 is supplied from the reservoir 16 to a T-shaped tube section 64 that is furthermore connected on one side with a back-pressure valve 62 and on the other side with a tube-shaped toner conveyance system 66. The toner material 12 supplied to the tube section 64 is siphoned off via the toner conveyance system 66.

A vacuum blower 84 generates a negative pressure in a central negative pressure line 44. A fine filter 82 and a coarse filter 78 are arranged between the central negative pressure line 44 and the vacuum blower 84. It is thereby prevented that toner material 12 is sucked into the vacuum blower 84. A residual toner reservoir 80 is also provided in which the toner material 12 filtered from the coarse filter 78 is collected. Further devices (not shown) of the printer or copier to be provided with negative pressure, such as, for example, a further toner conveyance system, are connected with the central negative pressure line 44. The toner conveyance system shown in FIG. 2 is connected via a control valve 74 with the central negative pressure line 44. The control valve 74 has an aeration device that serves to supply air as needed to the tube-shaped conduit 77 in order to generate in this tube-shaped conduit 77 an overpressure (for example at the height of the ambient pressure) relative to the central negative pressure line 44. A separation device 72 is provided on the top side of the temporary storage 28 facing towards the tube-shaped conduit 77. The separation device 72 can, for example, contain a filter means and serves to separate the toner material 12 from a supplied toner material-air mixture.

The tube-shaped toner conveyance system (tube-shaped conduit) 66 is connected with the temporary storage 28 below the separation device 72. A toner material-air mixture is generated with the aid of the negative pressure through the tube-shaped conduit 66, whereby what is known as an inflation current is generated by the back-pressure valve 62 for the transport of the toner material 12 supplied to the tube section 64. The toner material 12 is thus separated from the inflation air with the aid of the separation device 72. The toner material is supplied from the temporary storage 28 to the developer station 14 via a dosing device 70 via an essentially airtight sluice 68, for example via what is known as a cell wheel sluice. As already described in connection with FIG. 1, the tube-shaped conduit 77 is repeatedly, temporarily opened to the environmental air with the aid of an aeration element 76, such that the air current in the tube-shaped conduit 77 is temporarily reversed and air flows via the aeration element 76 through the tube-shaped conduit 77 and into the temporary storage 28 through the separation device 72. Toner material 12 that is stuck to separation elements in the separation device 72 is thereby loosened from these and falls into the temporary storage 28. It is thereby ensured that a sufficiently large air flow can subsequently flow through the separation device 72 again in order to generate the inflation current in the tube-shaped conduit 66 to transport toner material 12. Negative pressure is thereby sucked in at negative pressure distribution 86 in a first operation phase via the central negative pressure line 44 via the control valve 74, whereby the inflation current is generated to convey toner material 12 into the tube-shaped conduit 66.

In a second operation phase, the control valve 74 is closed and the aeration element 76 is opened. A negative pressure relative to the supplied ventilation air is present in the tube-shaped conduit 77 and the elements connected therewith (such as the temporary storage 28 and the tube-shaped conduit 66) due to the previously applied negative pressure. An air current is thereby generated through the tube-shaped conduit 77 towards the temporary storage 28. Air thereby at least temporarily flows through the separation device 72 in the opposite direction than in the first operation phase. Toner material 12 that adheres to separation elements, in particular to filter elements, is thereby loosened from these and falls into the temporary storage 28.

The conveyed toner quantity can be dosed both with the aid of the discharge device 60 and with the aid of the control valve 74. The toner quantity to be conveyed that is supplied to the tube section 64 must be controlled such that a sufficiently large inflation current is present in the tube-shaped conduit 66 in order to prevent obstructions of the tube-shaped conduit 66.

Figure 3:
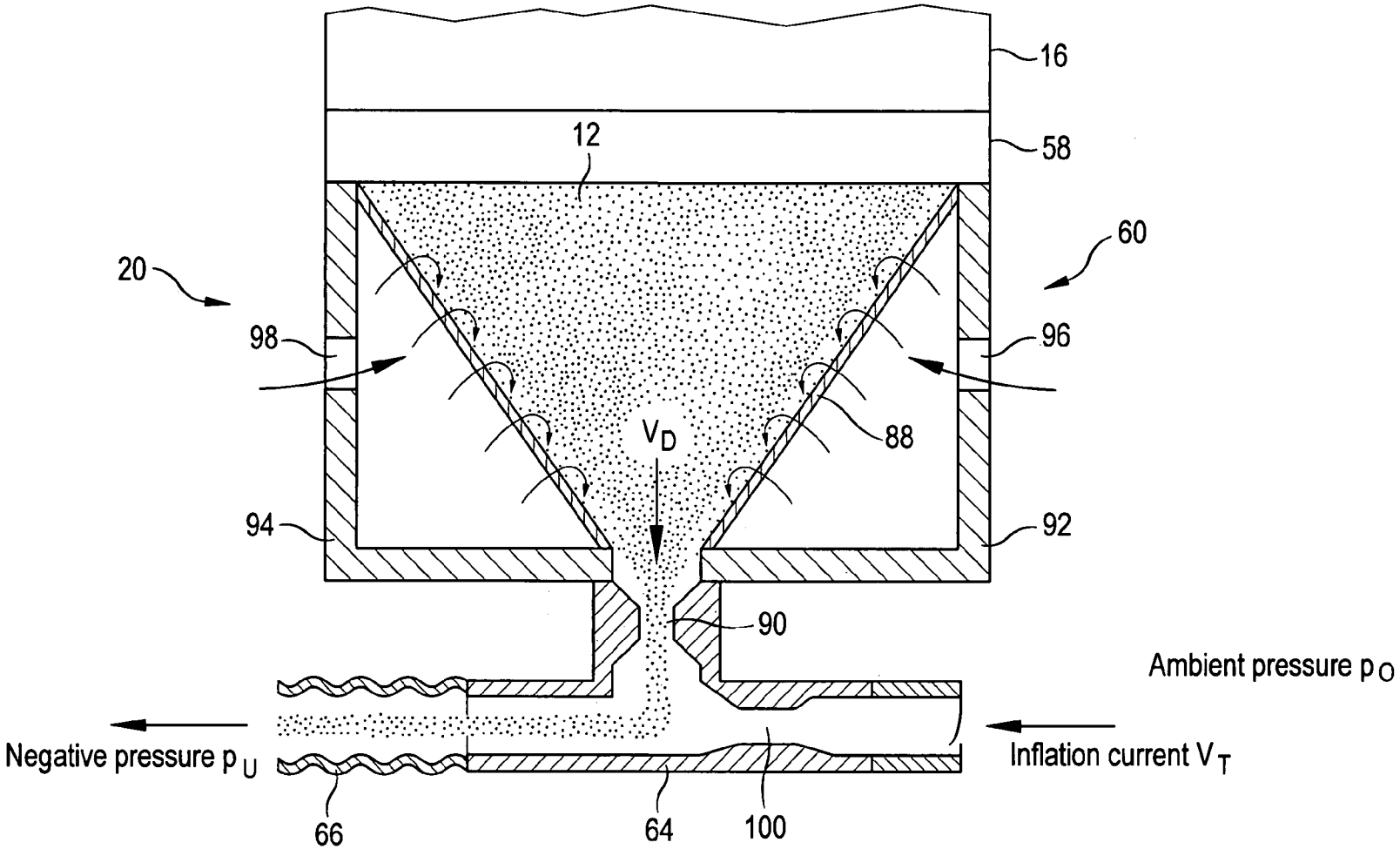
FIG. 3 is an arrangement to transport toner material from a reservoir.

The sealing device 20 with the discharge device 60 is shown in FIG. 3 in a section representation. As already explained in connection with FIGS. 1 and 2, the reservoir 16 is arranged with the opening facing downwards towards the coupling device 58 in the printer or copier. The toner material 12 slides from the reservoir 16 through the coupling device 58 into the discharge device 60. The discharge device 60 comprises a funnel 88 whose funnel outlet opens into the tube section 64. A dosing nozzle 90 is arranged at the funnel outlet facing the tube section 64. The discharge device 60 is connected airtight with the reservoir 16 via the coupling device 58.

The funnel walls of the funnel 88 contain air-permeable sections. The discharge device 60 is sealed from environmental air with the aid of airtight walls 92, 94. Environmental air can stream back into the inside of the discharge device 60 at the funnel walls via supply air openings. As already described in connection with FIGS. 1 and 2, a negative pressure $p_U$ is generated in the tube-shaped conduit 66 with the aid of a vacuum blower 84. A dosing nozzle 100 to dose the inflation current $V_T$ is arranged towards the back-pressure valve 62 (not shown in FIG. 3).

In addition to the inflation current $V_T$, the negative pressure $p_U$ also generates a dosing air current $V_D$. The dosing air current $V_D$ and the inflation current $V_T$ are determined by the openings of the dosing nozzles 90, 100 and by the negative pressure $p_U$ and are also controllable via the supply air openings 96, 98 at which, for example, respectively one supply air choke is arranged. The air of the dosing air current $V_D$ thus flows back through the supply air openings 96, 98. This supply air current penetrates through the air-permeable funnel walls (that, for example, comprise sinter glass or sinter metal) into the toner material 12. The toner material 12 is interspersed with the dosing air via this dosing air current $V_D$, such that a toner material-air mixture is created. The dosing air thereby fluidizes the toner material 12. In contrast to the powder-form toner material 12, the toner material-air mixture is free-flowing, whereby it can simply flow through the dosing nozzle 90 into the inflation current $V_T$ and can be further transported in the inflation current $V_T$ through the tube-shaped conduit 66.

In other exemplary embodiments, an overpressure relative to the ambient pressure (environment pressure) $p_0$ can also be applied at the supply air openings 96, 98, whereby the toner material-air mixture is both formed and pushed through the dosing nozzle 90 into the inflation current $V_T$.

Figure 4:
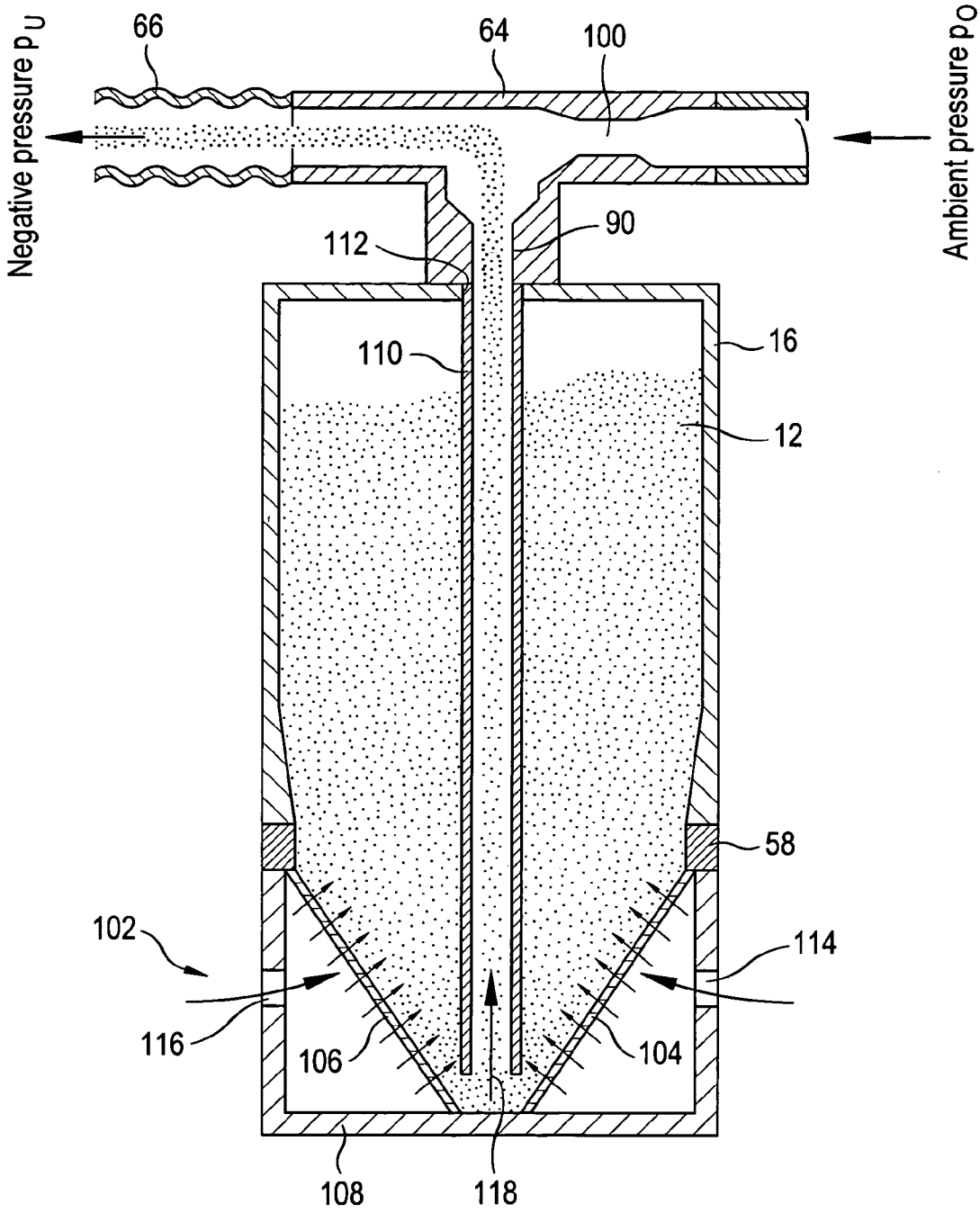
FIG. 4 is a second arrangement to transport toner material from a reservoir.

In FIG. 4, as a schematic alternative to the execution according to FIG. 3, a second arrangement for the transport of toner material 12 from a reservoir 16 is shown in which the toner material 12 is removed from the top of the reservoir 16. The reservoir 16 is connected with a discharge device 102 via a coupling device 58, similar as in the device according to FIG. 3. The discharge device 102 is connected airtight with the reservoir 16 via the coupling device 58. Just like the discharge device 60 according to FIG. 3, the discharge device 102 has inner walls 104, 106 arranged in the shape of a funnel that comprise a porous, air-permeable material. The outer wall 108 partitions the discharge device 102 airtight from the environment. A dip tube 110 is passed through an upper opening 112 of the reservoir 16, into a lower section with funnel-shaped inner walls 104, 106, through the toner material 12. A toner material-air mixture is conveyed or sucked through the tube-shaped conduit 66 via this dip tube 110 via a negative pressure $p_U$.

The tube-shaped conduit 66 and the dip tube 110 are respectively connected with the T-shaped tube section 64. Via the negative pressure in the dip tube 110, toner material 12 is conveyed from the funnel-shaped section of the discharge device 102 upwards into the tube-shaped conduit 66. An inflation current is thereby generated via the dosing nozzle 100 in the tube section 64 in the same manner as already described in connection with FIG. 3. Supply air openings 114, 116 via which the environmental air is supplied for the generation of a dosing air current 118 are provided in the outer wall of the discharge device 102. The back-flowing environmental air penetrates the inner walls 104, 106 of the discharge device 102 into the toner material 12, at least near the discharge device 102, and forms a toner material-air mixture. As already described, the toner material 12 is thereby fluidized and can flow through the dip tube 110 upwards to the tube section 64. Just as was already described in connection with FIG. 3, supply air chokes can also be arranged at the supply air openings 114, 116. It is also possible to provide only one supply air opening 114, 116. The supply air chokes can thereby be executed as a diaphragm or as a control valve.

In a first operation state in which no toner material is conveyed from the reservoir 16, ambient pressure is present between the inner walls 104, 106 and the outer wall 108. The volumes between the inner walls 104, 106 and the outer wall 108 form a buffer volume. In a second operation state, in particular at the beginning of the toner transport, the dosing air current 118 is temporarily increased with the aid of the additional air from the buffer volume, whereby a large quantity of the toner material-air mixture is relatively quickly generated in the region of the discharge device 102. In the further operation, the dosing air current 118 is limited by the back-flowing air quantity that flows back through the supply air openings 114, 116. This advantageously affects the transport properties of the toner material 12, particularly given a non-continuous operation of the toner transport.

The inner walls 88, 104, 106 can have a funnel and/or gutter shape or can even form a slanted plane, both in the discharge device 60 according to FIG. 3 and in the discharge device 102 according FIG. 4. Arrangements with horizontally arranged air-permeable inner walls are likewise possible, whereby in these arrangements at least the discharge device 60, 102 is not completely emptied of toner material 12. The inner walls 88, 104, 106 comprise, for example, sinter metal, sinter plastic, sifters and/or air filters and are thereby toner-sealed and air-permeable. It is thereby advantageous when these materials have a constant flow resistance. In other exemplary embodiments, the discharge device 60, 102 is a component of the reservoir 16.

In other advantageous exemplary embodiments, the dosing air nozzle 90 is equipped with a sealing device that only opens at a set negative pressure. The described arrangement to transport toner material 12 is suitable to transport pure toner material 12, to transport a two-component mixture made from toner material 12 and carrier particles, and to transport carrier particles for a two-component mixture.

Figure 5:
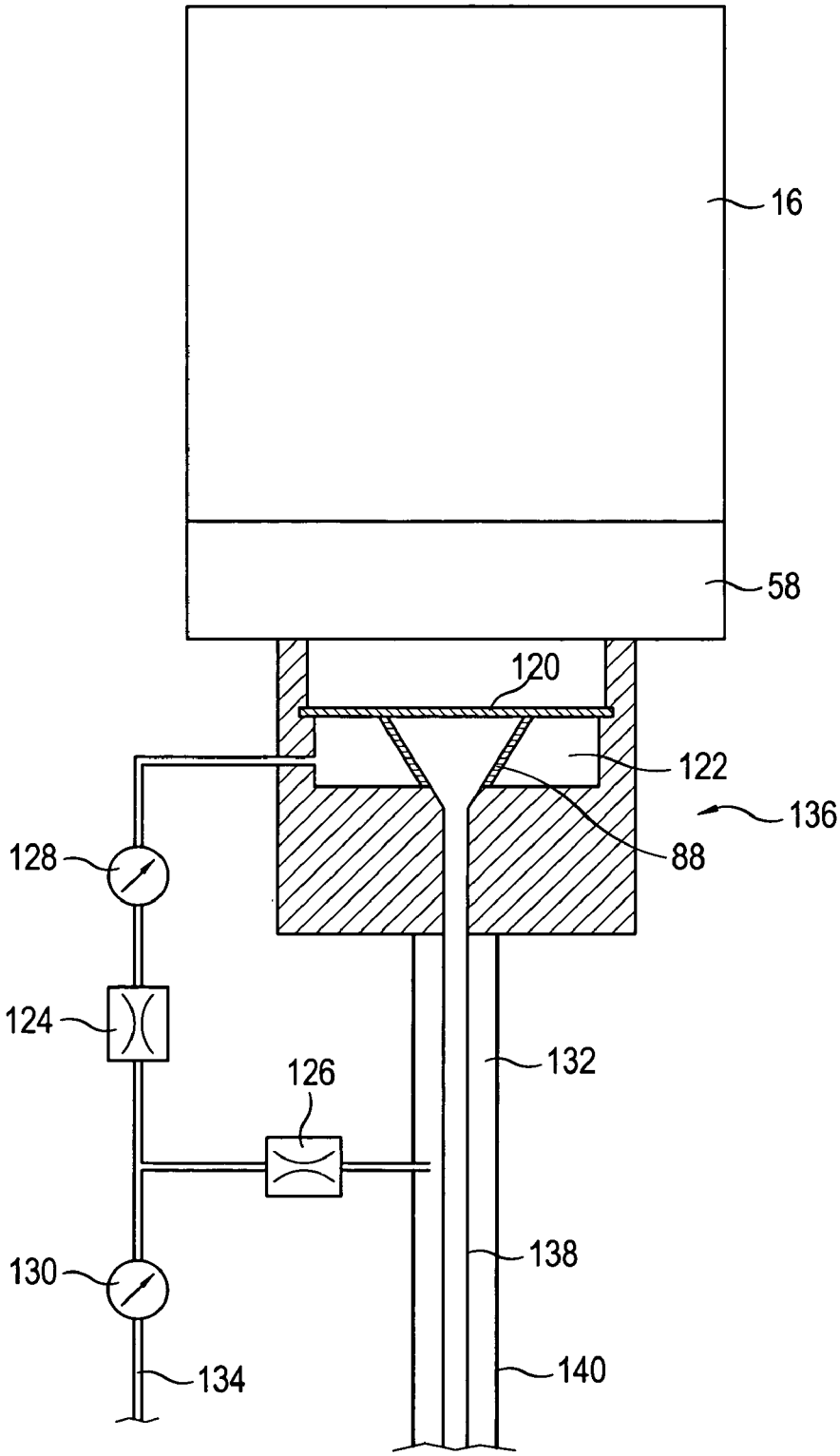
FIG. 5 is a third arrangement to transport toner material from a reservoir.

The schematic design of a third arrangement to convey toner material 12 from a reservoir 16 with the aid of a discharge device 136 is shown in FIG. 5. The discharge device 136 is connected airtight with the reservoir 16 via a coupling device 58. The discharge device 136 comprises a horizontally arranged air-permeable plate 120, for example a porous metal plate in the middle of which is arranged a funnel (funnel-shaped depression) 88. The toner material 12 from the reservoir 16 can, via an opening arranged at the bottom of the reservoir 16, slide through the coupling device 58 into the discharge device 136 into the funnel 88. Pressurized air that has been generated by a pressurized air generation unit (not shown) is fed into a pressure chamber 122 below the air-permeable plate (metal plate) 120 via a tube system 134.

The quantity of the supplied pressurized air is set with the aid of a choke 124. The pressure in the tube system 134 after the choke 124 is determined with the aid of a pressure sensor 128. The pressure in the pressurized air feed line of the tube system 134 is determined with the aid of a second pressure sensor 130. The supplied pressurized air penetrates through the air-permeable plate 120 and through air-permeable walls of the funnel-shaped depression 88 into the toner material 12 and, together with the toner material 12, forms a toner material-air mixture that is free-flowing. The free-flowing toner material-air mixture is pushed through the funnel outlet into a tube-shaped conduit 132 due to gravity and with the aid of a dosing transport current generated by the pressurized air. The tube-shaped conduit 132 has an inner tube-shaped element 138 that comprises toner-sealed and air-permeable elements and an outer tube-shaped, airtight element 140. Pressurized air is fed via a second choke 126 from the pressurized air supply line into an intervening space between the inner tube-shaped element 138 and the outer tube-shaped air-tight element 140 of the tube-shaped conduit 132. This pressurized air penetrates the entire length of the tube-shaped conduit 132 via the inner tube-shaped element 138 and continuously forms a toner material-air mixture inside the inner tube-shaped element 138. The toner material 12 is thus displaced into a free-flowing state over the entire length of the tube-shaped conduit 132. Given a filled reservoir 16, a pressure of approximately 20 millibar over ambient pressure is set via the choke 124 in the pressure chamber 122 arranged below the air-permeable plate (porous metal plate) 120 and next to the funnel-shaped depression 88. The intervening space between the inner first tube-shaped element 138 and the outer or second tube-shaped element 140 of the tube-shaped, air-tight conduit 132 is preset to approximately 10 millibar over ambient pressure via the second choke 126.

As already mentioned, the pressure sensor 128 determines the pressure in the pressure chamber 122. Given a decreasing fill level of the toner material 12 in the reservoir 16, the pressure in the pressure chamber 122 continuously decreases given constant choke setting of the choke 124. The choke 124 merely limits the discharge quantity. The pressure of the supplied pressurized air is determined with the aid of the pressure sensor 130. The measurement results of the pressure sensor 128 are compensated with the aid of the measurement results of the pressure sensor 130, whereby fluctuations of the pressure ratios in the supply air are compensated upon determination of the fill level present in the reservoir 16. The pressure fluctuations of the supply air lead to proportional pressure fluctuations in the pressure sensor 128 that are dependent on the fill level. To determine the fill level in the reservoir 16, the difference from the measurement values of the pressure sensors 130 and 128 can be generated, whereby this pressure difference is a measure for the fill level in the reservoir 16. A more concrete value for the fill level and/or for the quantity of toner material 12 that is located in the reservoir 16 is determined with the aid of a control unit (not shown) to which the measurement values of the pressure sensors 128, 130 are supplied. The determined fill level value can be displayed on a display unit of the printer or copier, whereby a signaling can also occur given an overshoot of a preset value.

Figure 6:
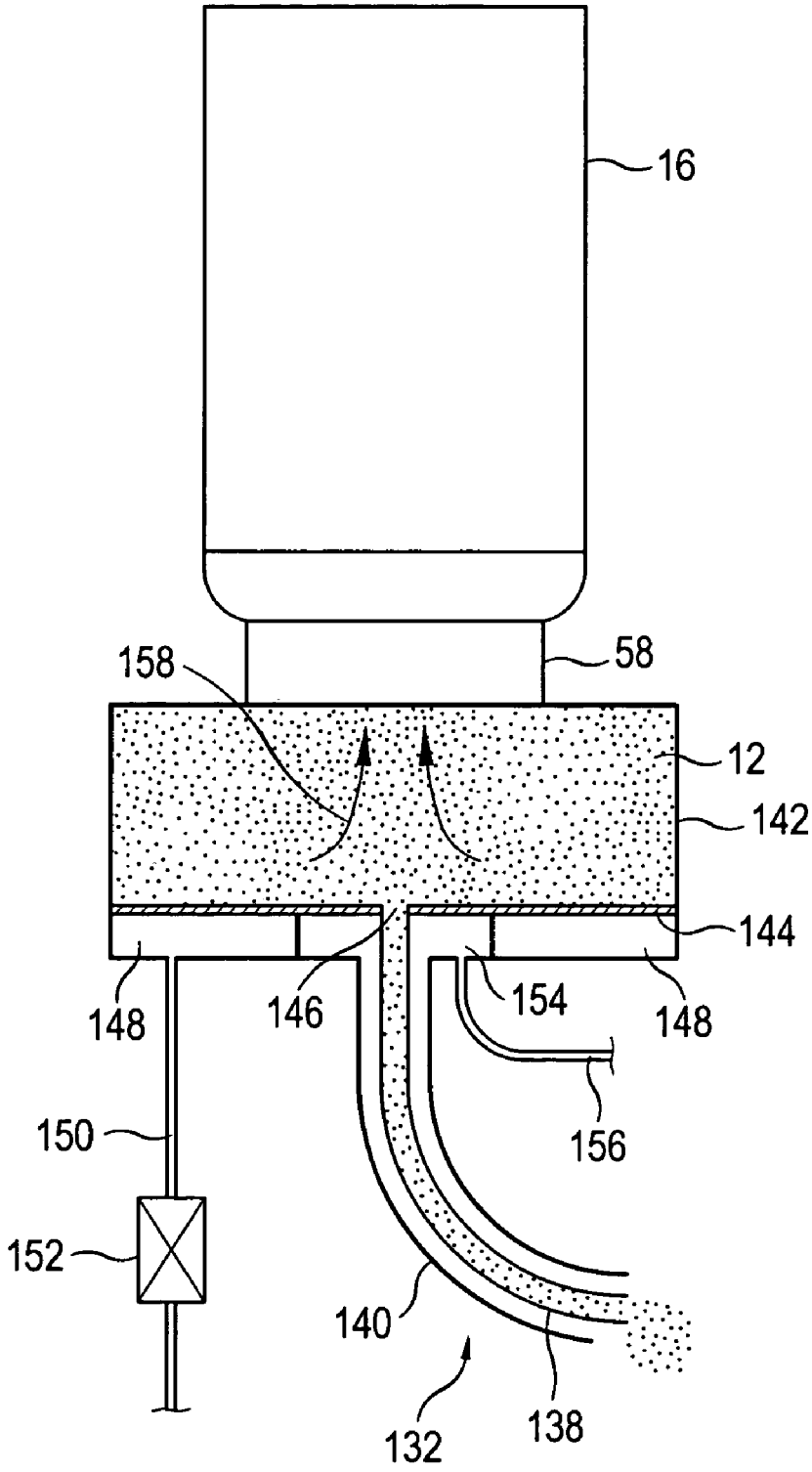
FIG. 6 is an alternative embodiment for the arrangement according to FIG. 5.

An embodiment of the toner conveyance system according to FIG. 5 is schematically shown in FIG. 6, in which toner material 12 is conveyed from a reservoir 16 into a tube-shaped conduit 132 with the aid of overpressure. The reservoir 16 is connected airtight with a temporary storage 142 via a coupling device 58. The toner material 12 slides from the reservoir 16 into the temporary storage 142. The proportions of reservoir 16 and temporary storage 142 shown in FIG. 6 can also be in such a way that, in a concrete embodiment in a printer or copier, the temporary storage 142 has only a small fraction of the volume of the reservoir 16. A porous metal plate 144 is arranged approximately horizontal in the temporary storage. For example, the porous metal plate 144 is a chromium-nickel-steel sinter plate with a pore size of approximately 2 μm. Such a metal plate 144 is air-permeable, however neither toner material 12 nor carrier particles can pass through this metal plate 144.

An inner tube-shaped element 138 of the tube-shaped conduit 132 is connected toner-sealed with a removal opening 146 in the metal plate 144 that is arranged approximately in the middle of the metal plate 144. The toner material 12 slides from the temporary storage 142 into the tube shaped conduit 132 via the removal opening 146. A pressure chamber 154 that is supplied with pressurized air with the aid of a pressurized air line 156 is arranged below this removal opening 146 and around this removal opening 146. The supplied pressurized air quantity is dimensioned such that a pressure of approximately 20 millibar over ambient pressure is established in this pressure chamber 154. The pressure chamber 154 is connected airtight with an outer tube element 140 of the tube-shaped conduit 132 such that the pressurized air (supplied with the aid of the pressurized air line 156) in an intervening space between the inner tube-shaped element 138 and the outer tube element 140 can arrive in the tube-shaped conduit 132.

The inner tube-shaped element 138 is, as already mentioned in connection with FIG. 5, porously air-permeable, whereby the air fed into the pressure chamber 154 is not only pushed through the porous metal plate 144 into the toner material 12 in the temporary storage 142, but rather is also pushed through the wall of the inner tube-shaped element 138 into this along the length of the tube-shaped conduit 132. Not only is the toner material-air mixture thereby formed in the temporary storage 142, but rather the toner material-air mixture conveyed into the tube-shaped conduit 132 is also further maintained in this tube-shaped conduit 132 as a free-flowing mixture. Obstructions in the tube-shaped conduit 132 are thereby prevented. Such a tube-shaped conduit 132 can also have bending points without toner accumulations that lead to an obstruction of the tube-shaped conduit 132 being created at these bending points. A second pressure chamber 148 below the metal plate 144 is arranged around the pressure chamber 154.

The second pressure chamber 148 is fed via a pressure line 150 that comprises a valve 152. The air pressure quantity supplied to the second pressure chamber 148 can be adjusted via the valve 152. The valve 152 can, for example, be executed as a magnet valve that can be controlled in an open and a closed setting. Depending on the density of the toner material 12, the second pressure chamber 148 is supplied with pressurized air to transport the toner material 12. However, up to a density of approximately 0.46 g/cm$^3$, the second pressure chamber 148 does not necessarily have to be supplied with pressurized air, since up to this density the environmental air flowing back over the second pressure chamber 148 is sufficient in order to form a toner material-air mixture at least in the region of the removal opening 146. The toner conveyance system shown in FIG. 6 is preferably arranged above a developer station 14. It is thereby possible to also arrange large-volume reservoirs 16 with a volume for toner material 12 in the range between 5 kg and 20 kg. The transport of the toner material 12 through the tube-shaped conduit 132 is thereby aided by gravity.

The arrows 158 indicate the current direction of the environmental or, respectively, pressurized air supplied to the temporary storage 142 through the porous metal plate 144, whereby a toner material-air mixture is also generated by this air in regions of the reservoir 16. The temporary storage 142, the pressure chambers 148, 154 as well as a tube-shaped conduit 132 are shown in a cut representation in FIG. 6.

Figure 7:
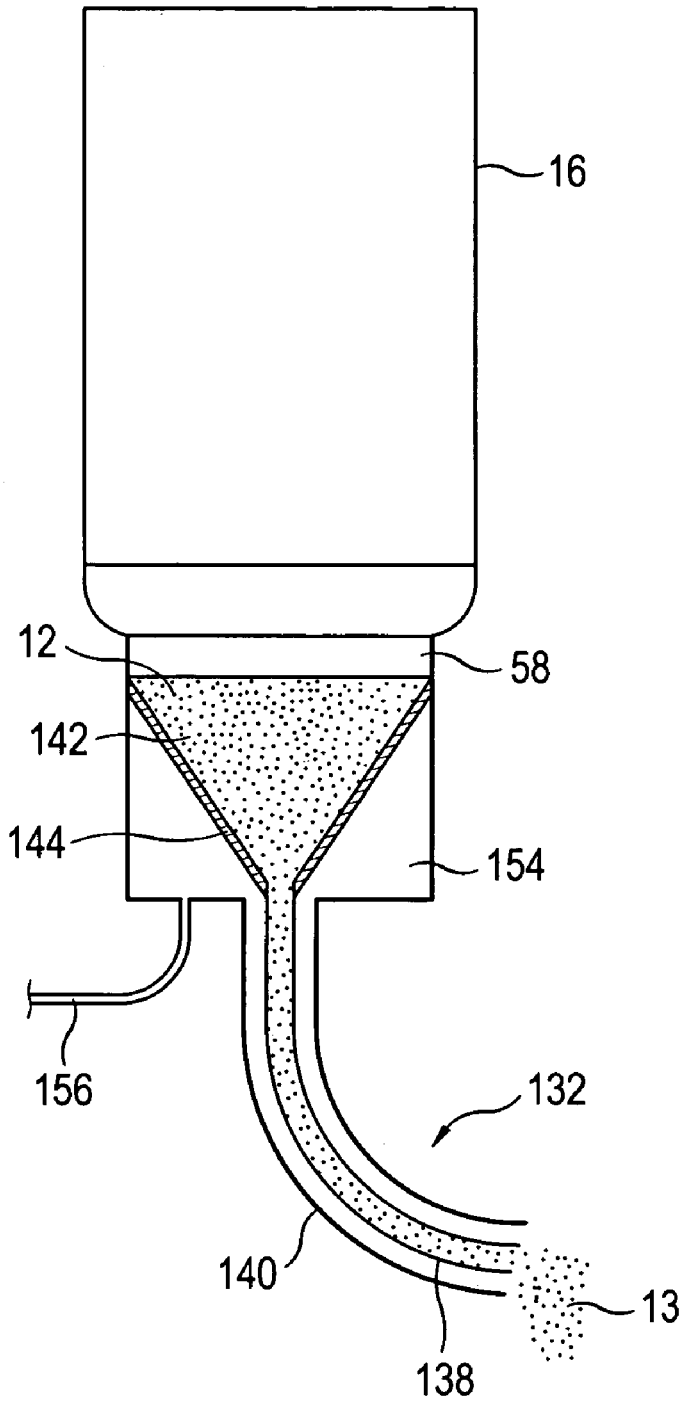
FIG. 7 is a further alternative embodiment for the arrangement shown in FIG. 5.

A further embodiment of the toner conveyance system according to FIG. 5 is shown in FIG. 7. In contrast to the toner conveyance system according to FIG. 6, the porous metal plate 144 in the system according to FIG. 7 is designed funnel-shaped. The inner tube-shaped element 138 is arranged at the funnel outlet and is connected toner-sealed with this. Pressurized air is supplied to the pressure chamber 154 with the aid of the pressurized airline 156. The pressure chamber 154 is arranged around the funnel-shaped metal plate 144. The toner material 12 slides from the reservoir 16 into the funnel formed by the porous metal plate 144.

The pressurized air supplied in the pressure chamber 154 is pushed through the porous metal plate 144 into the toner material 12, whereby a toner material-air mixture is generated. The toner material-air mixture then slides or, respectively, flows through the outlet opening of the funnel into the inner tube-shaped element 138 of the tube-shaped conduit 132. The outer tube element 140 of the tube-shaped conduit 132 is connected airtight with the pressure chamber 154, such that pressurized air is supplied into the intervening space between the inner tube-shaped element 138 and the outer tube element 140. The toner material-air mixture is thereby also further maintained in the tube-shaped conduit 132 and can simply be transported to the developer station 14 via the tube-shaped conduit 132. The toner material-air mixture 13 flows into the developer station 14 from the inner tube-shaped element 138 and falls into the developer station 14. The pressure chamber 154 and the temporary storage 142 are connected airtight with the reservoir 16 via a coupling device 58.

Figure 8:
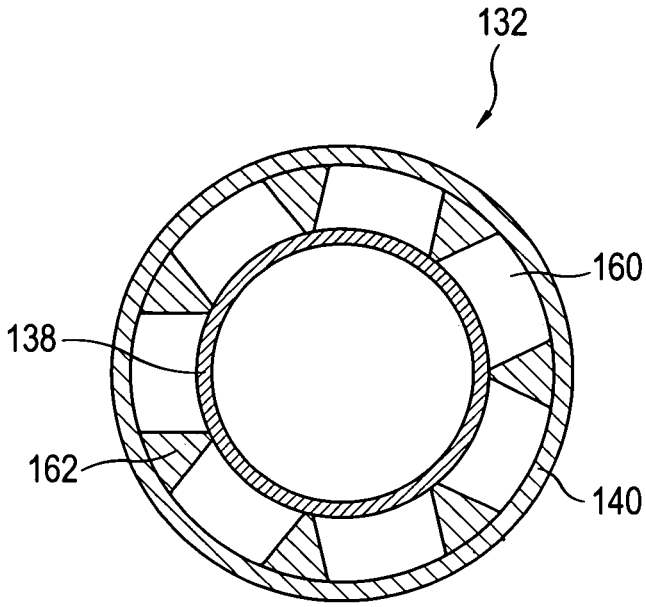
FIG. 8 shows a cross-section of a tube-shaped conduit for the conveyance of toner material.

A cross-section of the tube-shaped conduit 132 is shown in FIG. 8. The outer tube-shaped element 140 is airtight and has a separation 160 from the outer wall of the inner tube-shaped element 138. With the aid of spacers, of which one is designated with 162, it is ensured that pressurized air that is fed into the intervening space 160 is uniformly supplied on all sides of the inner tube-shaped element 138. The spacers 162 also ensure that, given a bending of the tube-shaped conduit 132 over its entire extent and the entire length of the first tube-shaped element 138, this is supplied with pressurized air.

As already mentioned, the inner tube-shaped element 138 comprises air-permeable materials, whereby pressurized air penetrates from the intervening space 160 through the inner tube-shaped element 138 into its inner space. A toner material-air mixture is formed with the toner material that is located within the inner tube-shaped element 138 via the in-flowing pressurized air. In other embodiments of the tube-shaped conduit 132, the provision of spacers 162 can also be foregone when, for example, relatively rigid tube elements 138, 140 are used and only a few contact points are to be expected between the inner tube-shaped element 138 and the outer tube element 140. Given the embodiment of the tube elements 138, 140 as flexible hoses, it is, however, advantageous to use spacers 162, since otherwise no toner material-air mixture is formed in sections of the tube-shaped conduit 132.

The inner tube-shaped element 138 is connected airtight with the outer tube element 140 at the exit opening of the tube-shaped conduit 132. It is thereby prevented that the pressurized air can simply escape from the intervening space 160 between the inner tube-shaped element 138 and the outer tube element 140, and thereby sufficient air is no longer pushed through the inner air-permeable tube-shaped element 138.

Figure 9:
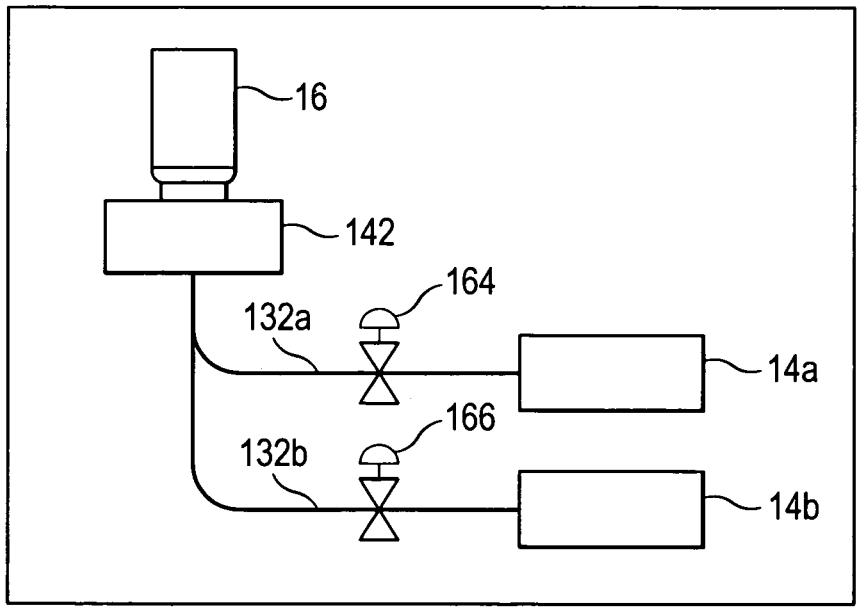
FIG. 9 shows an arrangement for the conveyance of toner material from a reservoir into a plurality of developer stations.

An arrangement for the transport of toner material from a reservoir 16 into a plurality of developer stations 14*a*, 14*b* in electrophotographic printers or copiers is schematically shown in FIG. 9. Toner material 12 is supplied to a temporary storage 142 from a reservoir 16. From this temporary storage 142, a toner material-air mixture is supplied to a first developer station 14*a* via a tube-shaped conduit 132*a*. From the temporary storage 142, a toner material-air mixture is likewise supplied to a second developer station 14*b* via a tube-shaped conduit 132*b*. The supply of the toner material 12 to the developer stations 14*a* and 14*b* occurs in alternate succession. The tube-shaped conduits 132*a*, 132*b* can be selectively sealed with the aid of the valves 164, 166 arranged in the tube-shaped conduits 132*a*, 132*b*. This arrangement is then in particular advantageous when two printing groups are provided with one developer station per printing group in an electrophotographic printer or copier, for example to print a front side and a back side on a carrier material. However, the temporary storage 142 can also be used to supply toner material 12 to developer stations 14*a*, 14*b* that are arranged in different electrophotographic printers or copiers.

Figure 10:
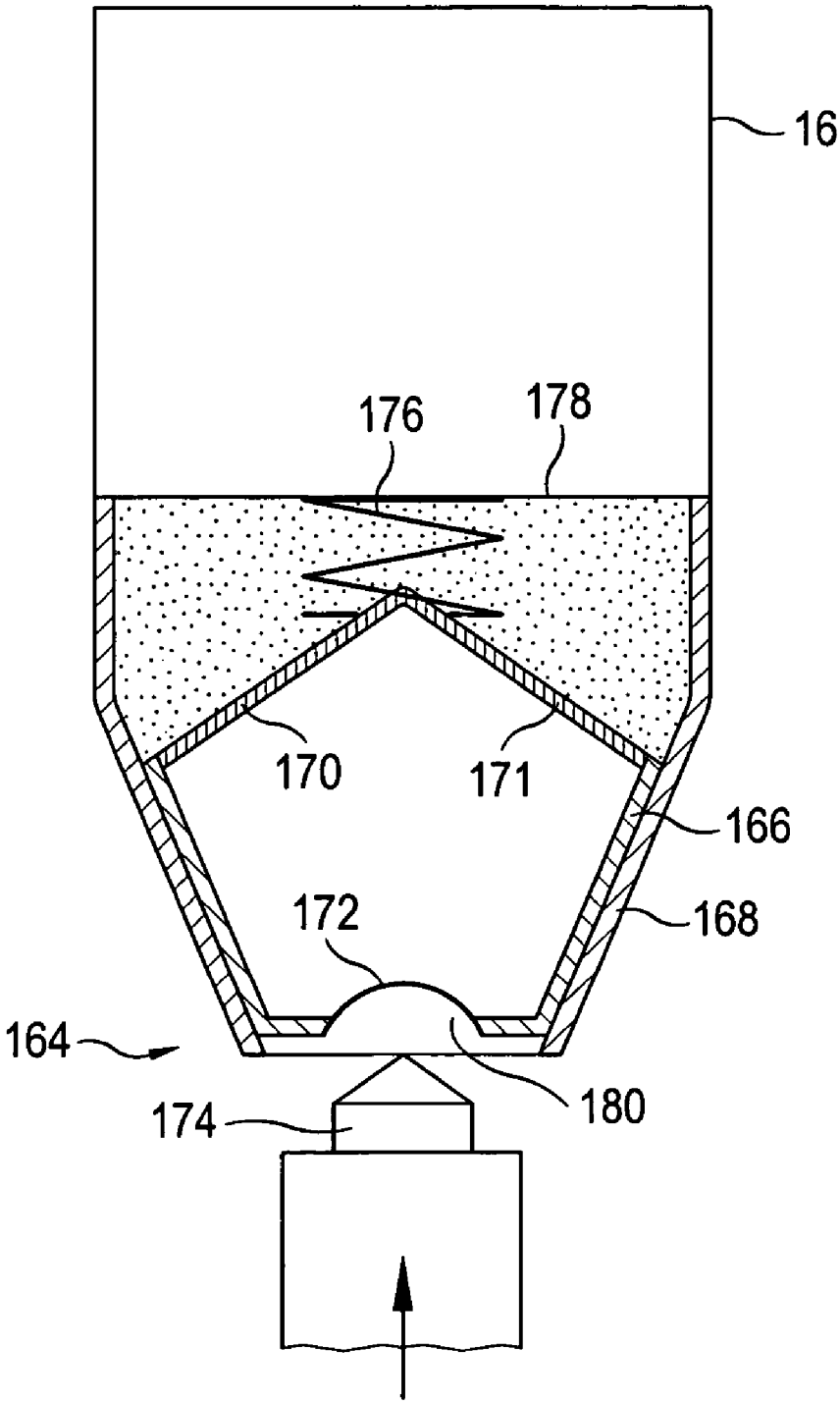
FIG. 10 illustrates a reservoir with a sealing device into which compressed air is fed with the aid of a compressed air supply.

A reservoir 16 with a sealing device 164 is shown in FIG. 10. The reservoir 16 has a conical section 168 facing a removal opening 180. A sealing element 166 is arranged inside the reservoir 16. The sealing element 166 likewise externally has conically-designed walls in the section of the conical section (conical reservoir walls) 168, whereby the conicities approximately coincide. The sealing element 166 is pushed towards the removal opening 180 by a spring 176. The conical outer walls of the sealing element 166 are thereby pressed against the conical reservoir walls 168 of the reservoir 16, such that no toner material 12 arrives at the removal opening 180. The spring 176 is pre-stressed by a spring mounting 178, whereby the sealing element 166 is pressed against the conical reservoir walls 168. The sealing element 166 thus forms a plug in front of the removal opening 180. The sealing element 166 has, porous, air-permeable sections 170, 171 facing towards the inside of the reservoir 16.

A pressurized air nozzle 174 is inserted into a pressurized air inlet 172 of the sealing element 166 to remove toner material 12 from the reservoir 16. The pressurized air nozzle 174 is thereby led through the removal opening 180 of the reservoir 16. The pressurized air nozzle 174 is thereby inserted into the reservoir 16 so far that the sealing element 166 is pushed (counter to the spring force) away from the removal opening 180 into the inside of the reservoir 16, whereby a gap forms in the conical section 168 of the reservoir 16.

Figure 11:
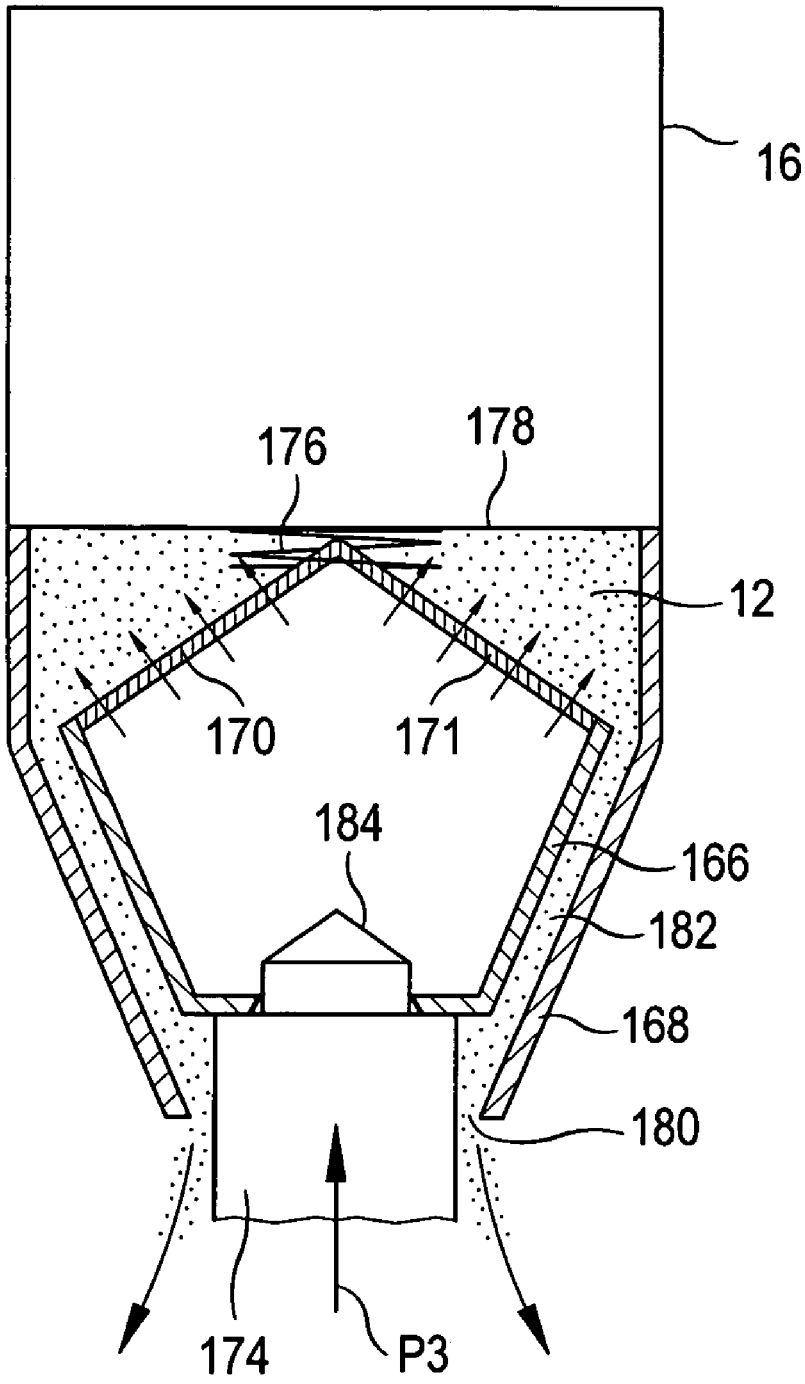
FIG. 11 shows a reservoir according to FIG. 10, wherein the sealing element is arranged in a second position for the removal of toner material.

In FIG. 11, the reservoir 16 according to FIG. 10 is shown in the open state for the removal of toner material 12 from the reservoir 16. As already described in connection with FIG. 10, the sealing element 166 is shifted into the reservoir 16 in the direction of the arrow P3 with the aid of the pressurized air nozzle 174. The spring 176 is thereby further pre-stressed. A gap through which toner material 12 can slide down towards the removal opening 180 is formed between the conical reservoir wall 168 and the sealing element 166 by pushing the sealing element 166 into the reservoir 16. Pressurized air is fed into the inside of the sealing element 166 with the aid of the pressurized air nozzle 174 at pressurized air outlet point 184. The pressurized air is pushed through the porous, air-permeable sections 170, 171 of the sealing element 166 into the toner material 12. The flow through the air-permeable sections 170, 171 upon supply of pressurized air is shown with the aid of arrows. The toner material 12 is flowed through by this pressurized air, whereby a free-flowing toner material-air mixture is formed. The toner material-air mixture can thereby very simply flow through the gap 182 towards the removal opening 180 and escape through this.

Furthermore, also referenced in this context are the patent applications with the internal file number 20010510 and 200E0511 submitted simultaneously by the applicant with this patent application and which concern a method and a device for the transport of toner material from a reservoir and a device and a method for the dosing of toner material in an electrophotographic printer or copier. Both of these patent applications are incorporated into the present specification by reference.

While preferred embodiments have been illustrated and described in detail in the drawings and foregoing description, the same are to be considered as illustrative and not restrictive in character, it being understood that only the preferred embodiments have been shown and described and that all changes and modifications that come within the spirit of the invention both now or in the future are desired to be protected.

We claim as our invention:

1. A method for transport of toner material from a reservoir arrangement, comprising the steps of:

providing the reservoir arrangement containing the toner material with a removal opening for removal of the toner material;

transporting the toner material away from the removal opening with aid of a tube-shaped conduit connected at least with the removal opening, the toner material being transported in the conduit via an air current;

generating a negative pressure relative to environment pressure at the removal opening via the air current in the conduit;

providing the reservoir arrangement with at least one air-permeable and toner-tight region through which air is sucked into the reservoir arrangement upon application of the negative pressure; and partitioning at least the air-permeable and toner-tight region airtight from the environment, environment air being supplied to the partitioned region via a dosing nozzle.

2. A method according to claim 1 wherein the reservoir arrangement comprises a toner reservoir and a sealing device.

3. A method according to claim 1 wherein the air current in the conduit is generated via at least one of a negative pressure and via an overpressure respectively applied at one end of the conduit.

4. A method according to claim 1 wherein the air-permeable toner-tight region is arranged in proximity to the removal opening.

5. A method according to claim 1 wherein air is drawn into the toner material through the air-permeable toner-tight region via the air current, whereby a toner material-air mixture is generated at least in one part of the reservoir arrangement with the aid of the supplied air.

6. A method according to claim 1 wherein the removal opening is arranged in a section of the reservoir arrangement lying at a lower part of a reservoir at a removal location.

7. A method according to claim 1 wherein the toner material slides towards the removal opening via reservoir walls arranged like a funnel.

8. A method according to claim 1 wherein the removal opening is arranged above a reservoir at a removal location, and the toner material is siphoned upwards through the reservoir.

9. A method according to claim 1 wherein the air-permeable toner-tight region comprises at least one sinter material made from at least one of steel, iron and bronze.

10. A method according to claim 1 wherein the air-permeable toner-tight region comprises at least one of a sieve and a filter unit.

11. A device for transport of toner material, comprising:

a reservoir arrangement that contains toner material that is removed from the reservoir arrangement via a removal opening;

a tube-shaped conduit connected at least with the removal opening and via which the toner material is transported away from the removal opening;

an air current in the conduit via which the toner material is transported through the conduit, the air current generating a negative pressure relative to environment pressure at the removal opening;

the reservoir arrangement having at least one air-permeable and toner-tight region through which air is sucked into the reservoir arrangement upon application of the negative pressure;

at least the air-permeable and toner-tight region being partitioned airtight from the environment; and the partitioned region being supplied with environment air via a dosing nozzle.

12. A device according to claim 11 wherein the conduit for the transport of toner material comprises a first tube-shaped element whose wall is at least partially air-permeable, and a second tube-shaped element inside which the first tube-shaped element is arranged, the second tube-shaped element being essentially airtight.

13. A device of claim 12 wherein the conduit comprises a separation present between the outer wall of the first tube-shaped element and the inner wall of the second tube-shaped element.

14. A device of claim 13 wherein the conduit comprises at least one spacer between the outer wall of the first tube-shaped element and the inner wall of the second tube-shaped element.

15. A device of claim 12 wherein the conduit comprises pressurized air supplied to the second tube-shaped element.

16. A device of claim 12 wherein the conduit comprises pressurized air supplied to the second tube-shaped element being supplied into a separation between the first and second tube-shaped elements, the pressurized air entering into the inside of the first tube-shaped element through a wall of the first tube-shaped element.

17. A device of claim 12 wherein toner material is conveyed inside the first tube-shaped element.

18. A method for transport of toner material from a reservoir arrangement, comprising the steps of:

providing the reservoir arrangement containing the toner material with a removal opening for removal of the toner material;

transporting the toner material away from the removal opening with aid of a conduit connected at least with the removal opening, the toner material being transported in the conduit via an air current;

generating a negative pressure relative to environment pressure at the removal opening via the air current in the conduit;

providing the reservoir arrangement with at least one air-permeable toner-tight region through which air is sucked into the reservoir arrangement upon application of the negative pressure; and partitioning at least the air-permeable and toner-tight region airtight from the environment, environment air being supplied to the partitioned region.

* * * * *